US009707691B2

(12) United States Patent
Lindstrom et al.

(10) Patent No.: US 9,707,691 B2
(45) Date of Patent: Jul. 18, 2017

(54) CONDUIT CUTTING TOOLS AND CONDUIT CUTTING TOOL OPERATIONAL METHODS

(71) Applicant: RL Tools, L.L.C., Clinton, MT (US)

(72) Inventors: Paul Lindstrom, Clinton, MT (US); Mike Raunig, Missoula, MT (US); Chris Loraas, Bismarck, ND (US)

(73) Assignee: RL Tools, L.L.C., Clinton, MT (US)

( * ) Notice: Subject to any disclaimer, the term of this patent is extended or adjusted under 35 U.S.C. 154(b) by 341 days.

(21) Appl. No.: 14/145,231

(22) Filed: Dec. 31, 2013

(65) Prior Publication Data

US 2014/0196584 A1 Jul. 17, 2014

Related U.S. Application Data

(60) Provisional application No. 61/848,816, filed on Jan. 14, 2013.

(51) Int. Cl.
*B26D 3/16* (2006.01)

(52) U.S. Cl.
CPC ..... *B26D 3/169* (2013.01); *Y10T 83/04* (2015.04)

(58) Field of Classification Search
CPC ..... B26D 3/169; B23D 21/06; B23D 21/08; B23D 21/10
USPC ..... 30/92, 92.5, 93–108
See application file for complete search history.

(56) References Cited

U.S. PATENT DOCUMENTS 3,025,597 A * 3/1962 Huglin ..... B23D 21/08 30/102
4,026,018 A * 5/1977 Byberg ..... H02G 1/005 30/254
RE31,674 E * 9/1984 Wozniak ..... B23D 17/08 83/605
4,558,515 A * 12/1985 LaBounty ..... E02F 3/965 144/34.5
4,847,997 A * 7/1989 Petty ..... B26D 3/169 30/102
4,858,316 A * 8/1989 Dubey ..... B23D 21/08 30/102
5,060,378 A * 10/1991 LaBounty ..... E01C 23/122 30/134
5,206,996 A * 5/1993 McDaniel ..... B26D 3/169 30/101

(Continued)

OTHER PUBLICATIONS

"Tool " Photographs, 1980, 6 pages.

*Primary Examiner* — Jason Daniel Prone
*Assistant Examiner* — Richard Crosby, Jr.
(74) *Attorney, Agent, or Firm* — Wells St. John P.S.

(57) ABSTRACT

Conduit cutting tools and conduit cutting tool operational methods are described. According to one aspect, a conduit cutting tool includes a pivot pin, a pair of elongated members coupled with the pivot pin, and wherein the elongated members include a jaw and a handle and interior portions of the jaws include cutting blades, wherein the jaws are spaced apart from one another in an open configuration to receive a conduit and one of the elongated members is configured to move with respect to an other of the elongated members as a result of an input force to the handles, and wherein the movement of the one elongated member rotates the jaw of the one elongated member towards the jaw of the other elongated member and moves the jaw of the one elongated member in a substantially linear direction towards the jaw of the other elongated member.

6 Claims, 4 Drawing Sheets

(56) References Cited

U.S. PATENT DOCUMENTS

| | | | | | |
|---|---|---|---|---|---|
| 5,581,886 | A * | 12/1996 | Sesser | B23D 21/08 | 30/101 |
| 5,718,051 | A * | 2/1998 | Huang | B23D 21/10 | 30/250 |
| 5,862,593 | A * | 1/1999 | Huang | B26D 3/169 | 30/182 |
| 6,739,055 | B2 * | 5/2004 | Lee | B23D 21/08 | 30/101 |
| 7,503,243 | B2 * | 3/2009 | Putsch | B25B 7/10 | 81/409.5 |
| 7,743,509 | B2 * | 6/2010 | Macsay | B26D 3/169 | 30/192 |
| 7,886,446 | B2 * | 2/2011 | Yu Chen | B26B 13/26 | 30/175 |
| 8,266,991 | B2 * | 9/2012 | Thorson | B23D 21/04 | 30/101 |
| 8,578,614 | B2 * | 11/2013 | Hernandez | B26D 3/169 | 30/184 |
| 9,089,958 | B2 * | 7/2015 | Cleland | B23D 21/02 | |
| 2002/0170182 | A1 * | 11/2002 | Nordlin | B23D 29/023 | 30/251 |
| 2010/0146795 | A1 * | 6/2010 | Houle | B26B 13/08 | 30/134 |
| 2011/0258860 | A1 * | 10/2011 | Chervenak | B26B 17/02 | 30/266 |
| 2012/0102752 | A1 * | 5/2012 | Steele | B26D 3/169 | 30/92 |
| 2013/0118015 | A1 * | 5/2013 | Smith | B26D 3/169 | 30/92 |
| 2015/0340849 | A1 * | 11/2015 | Kochi | B23D 21/06 | 30/251 |

* cited by examiner

CONDUIT CUTTING TOOLS AND CONDUIT CUTTING TOOL OPERATIONAL METHODS

RELATED PATENT DATA

This application claims priority to U.S. Provisional Patent Application Ser. No. 61/848,816, filed Jan. 14, 2013, entitled "PVC Cylindrical Material Cutting Device", the disclosure of which is incorporated herein by reference.

TECHNICAL FIELD

This disclosure relates to conduit cutting tools and conduit cutting tool operational methods.

BACKGROUND OF THE DISCLOSURE

Insulated electrical wires may be carried within conduits which may be installed in building structures or buried in different example applications. Currently, there are risks to cutting the conduits (often PVC) to length while insulated wires are present in the interior of the conduit. For example, the interior wires may be damaged during the cutting process necessitating repairs as well as placing the operator cutting the conduit at risk of potential electrical shock.

At least some embodiments of the disclosure are directed towards conduit cutting tools and methods of operation of the tools. Additional aspects of the disclosure are described below.

BRIEF DESCRIPTION OF THE DRAWINGS

Example embodiments of the disclosure are described below with reference to the following accompanying drawings.

DETAILED DESCRIPTION OF THE DISCLOSURE

This disclosure is submitted in furtherance of the constitutional purposes of the U.S. Patent Laws "to promote the progress of science and useful arts" (Article 1, Section 8).

At least some aspects of the present disclosure are directed towards apparatus and methods of use to cut circular conduits, such as PVC pipe, to desired length. The conduits may include sensitive contents in some applications (e.g., electrical wires) and some embodiments of the disclosure are directed towards apparatus and methods of facilitating the cutting of these conduits while avoiding damage to the contents of the conduits during the cutting.

Figure 1:
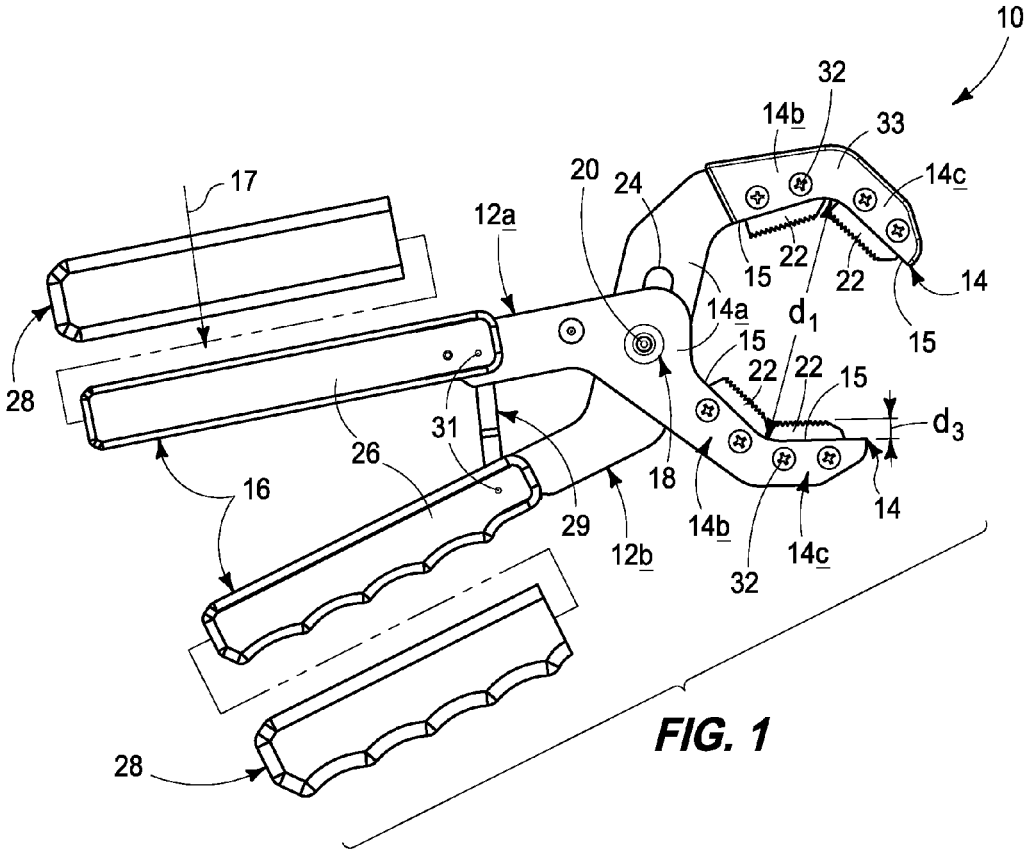
FIG. 1 is an illustrative representation of a conduit cutting tool according to one embodiment in an open configuration.
Figure 2:
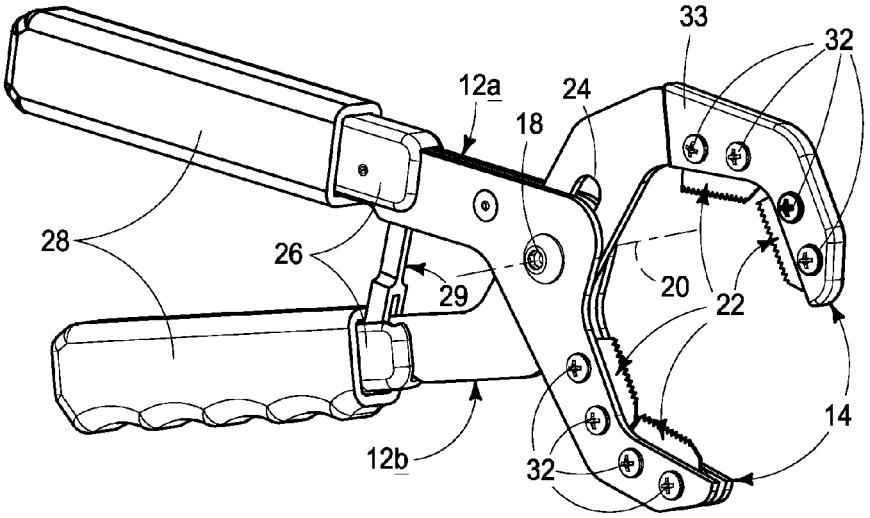
FIG. 2 is a perspective view of a conduit cutting tool according to one embodiment in an open configuration.

Referring to FIGS. 1 and 2, a conduit cutting tool 10 is shown according to one example embodiment of the disclosure. The depicted embodiment of the conduit cutting tool 10 is configured to be utilized by an individual to cut conduits of different gauges and diameters as discussed further below.

The illustrated conduit cutting tool 10 includes a plurality of elongated members 12*a*, 12*b*. Individual ones of the elongated members 12*a*, 12*b* include a jaw 14 at a first end and a handle 16 at a second end which is opposite to the first end. Elongated members 12*a*, 12*b* may be a suitable material, such as steel, to withstand forces generated during cutting operations.

The elongated members 12*a*, 12*b* are coupled with another in parallel planes via a pivot pin 18. The pivot pin 18 permits rotation of the elongated members 12*a*, 12*b* with respect to one another during operation. Pivot pin 18 defines a pivot axis 20 which is substantially perpendicular to the planes of the elongated members 12*a*, 12*b* in one embodiment.

As shown in the embodiment of FIG. 1, interior portions of jaws 14 include a plurality of cutting blades 22 which are configured to cut through walls of a conduit to be cut. Each jaw 14 includes a plurality of substantially linear segments 14*a*, 14*b*, 14*c* which arrange the cutting blades 22 in an angular relationship with one another to define a generally circular cutting configuration during use. The outermost segments 14*c* of jaws 14 are tapered in the illustrated embodiment to enable use of the tool 10 in low clearance areas.

In the illustrated embodiment, grips 26 are installed over the surfaces of the handles 16. Grips 26 are ergonomic and may be constructed of an electrically-insulating material, such as a suitable plastic or rubber, and capable of protecting the user from moderate electrical currents. In addition, a plurality of grip covers 28 are provided about grips 26 and which may be constructed of a foam, rubber or other suitable electrically-insulating material in example embodiments. Grip covers 28 provide cushion to the users' hands during use as well as additional electrical insulation.

The conduit cutting tool 10 is illustrated in an open configuration in FIG. 1. Tool 10 is able to receive conduits to be cut between jaws 14 when tool 10 is in the open configuration. In the illustrated example embodiment, the jaws 14 are spaced from one another by an increased distance d1 when tool 10 is the open configuration compared with a distance d2 when the tool 10 is in the closed configuration described further below and as shown in FIG. 5 in one example.

A user may apply an input force 17 during use which urges the handles 16 towards one another and causes at least one of the elongated members 12*a*, 12*b* to move with respect to the other elongated member 12*a*, 12*b* which changes the configuration of the tool 10 from the open to the closed configurations. In one example, the handle 16 of elongated member 12*b* may be fixed and input force 17 may be applied by a user to the handle 16 of elongated member 12*a* which moves the handle 16 of elongated member 12*a* towards the handle 16 of elongated member 12*b*.

In one embodiment, elongated member 12*b* includes an elongated slot 24 which receives pivot pin 18 and pivot pin 18 moves within slot 24 during movement of the elongated member 12*a* and cutting operations of the conduit cutting tool 10. Slot 24 defines a path of movement of pivot pin 18 and elongated member 12*a* during changes of the conduit cutting tool 10 between the open and closed configurations. In addition, slot 24 defines the spacing of jaws 14 from another and orientation of jaws 14 relative to one another during use in the depicted example embodiment.

Figure 5:
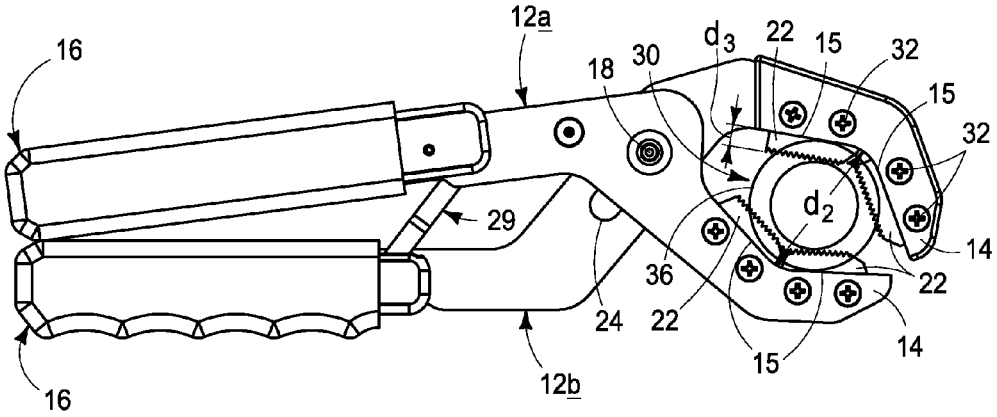
FIG. 5 is an illustrative representation of a conduit cutting tool according to one embodiment cutting through a conduit.

In FIG. 1, the pivot pin 18 is shown adjacent to a first end of slot 24 corresponding to the open configuration of tool 10, while in FIG. 5, the pivot pin 18 is shown adjacent to a second end of slot which opposite to the first end and corresponds to the closed configuration of tool 10. In the illustrated example embodiment, slot 24 is arranged to provide substantially linear movement of the jaws 14 relative to one another between the open and closed configurations. In addition, jaw 14 of elongated member 12*a* is configured to rotate about pivot pin 18 and relative to jaw 14 of elongated member 12*b* during changes of the conduit cutting tool 10 between the open and closed configurations.

Conduit cutting tool 10 includes a compression slide linkage 29 which is coupled with each of handles 16. In one embodiment, plural holes 27 of linkage 29 are coupled with individual ones of the handles 16 at respective pivot points 31 which enables linkage 29 to rotate relative to the pivot points 31 during movement of the elongated members 12*a*, 12*b* relative to one another. In one embodiment, the linkage 29 rotates in a counter-clockwise direction about the pivot pin 31 of elongated member 12*a* and the linkage 29 rotates in a clockwise direction about the pivot pin 31 of elongated member 12*b* as a result of input force 17. The compression slide linkage 29 generates an intermediate pivot link force from the pivot pin 31 of elongated member 12*b* towards the pivot pin 31 of elongated member 12*a* which forces the pivot pin 18 to slide within slot 24 when the handles 16 are moved towards one another by the user. The application of force 17 results in a force by the elongated member 12*a* on the slot 24 of the elongated member 12*b* at the pivot pin 18 which is in a direction towards the handle 16 of the elongated member 12*a* and perpendicular to the slot 24.

Leverage of the jaws 14 increases with respect to the conduit being cut as the angle of the slide linkage 29 decreases relative to elongated member 12*b* (e.g., jaws 14 impart a force of about 1:1 to the conduit being cut when cutting a conduit having a 2" diameter in the illustrated example embodiment). In the described embodiment, the slide linkage 29 enables the range of motion of the user's hand to cut different conduits having a relatively wide range of diameters. The conduit cutting tool 10 is configured to cut 1¼"-2" diameter PVC schedule 80 conduits in the example described embodiments. Other configurations of tool 10 having different sizes may be utilized to conduits of other diameters in other embodiments.

Referring to FIG. 2, the cutting blades 22 are attached to jaws 14 using plural retaining devices 32, such as screws, in one embodiment. Accordingly, cutting blades 22 are removable in the illustrated embodiment and cutting blades 22 of different dimensions may be supplied with tool 10 for use to cut conduits of different gauges. For example, a set of cutting blades 22 having a uniform cutting depth d3 (see FIG. 1) corresponding to a thickness of a wall of the conduit to be cut is selected and attached to the jaws 14 using the retention devices 32. In one embodiment, cutting blades 22 having a cutting depth which is equal to the thickness of the wall of the conduit to be cut are utilized.

Elongated member 12*b* includes a protective plate 33 which covers portions of the front, back and top surfaces of jaw 14 as shown in the illustrated embodiment. Protective plate 33 may be a suitable electrically insulative material, such as plastic, in some embodiments. Cutting blades 32 may be received within the protective plate 33 and retained between an interior surface of the protective plate 33 and the jaw 14 of elongated member 12*b* by the retaining devices 32 and which provides the cutting blades 22 in a configuration to extend an appropriate distance from interior surfaces 15 of jaws 14. In some embodiments, jaws 14 may include slots which allow blades 22 to be adjusted inward and outward relative to jaw surfaces 15 to adjust the distance d3 which the cutting blades 22 extend past surfaces 15 of jaws 14.

Figure 3:
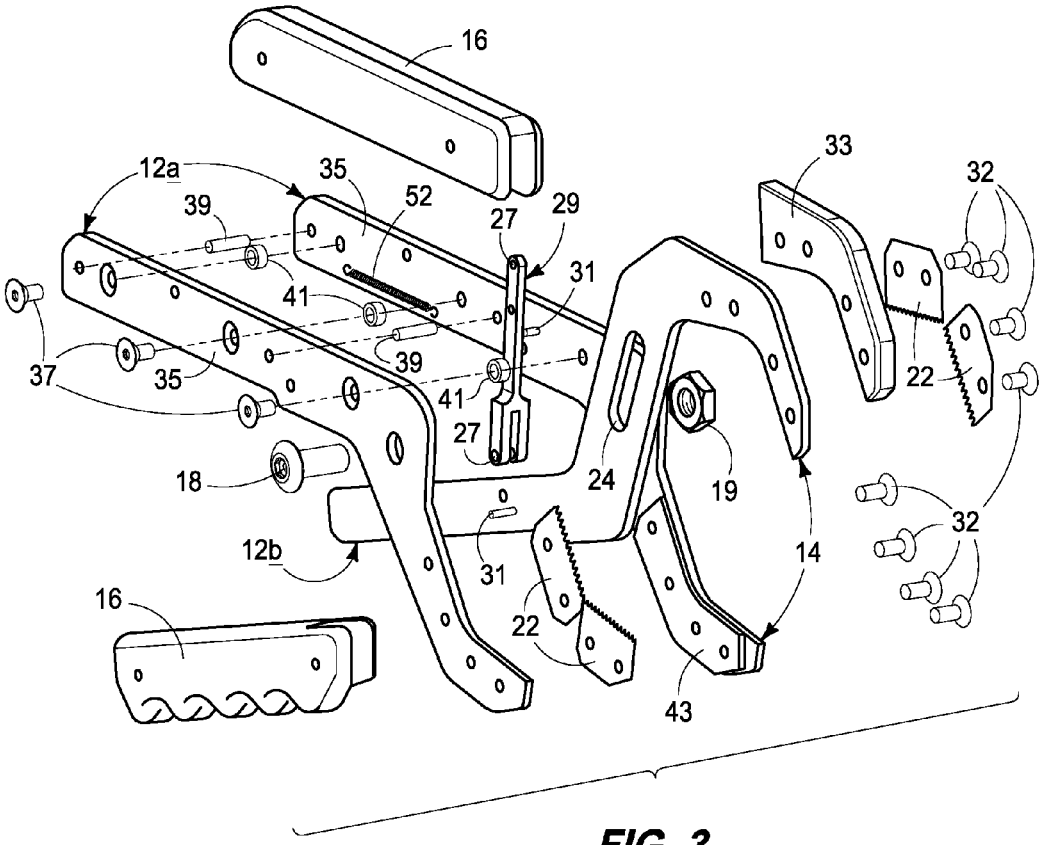
FIG. 3 is an exploded view of a conduit cutting tool according to one embodiment.

Referring to FIG. 3, additional details of one embodiment of conduit cutting tool 10 are shown according to one embodiment. Elongated member 12*a* includes a plurality of parallel members 35 which may be attached in a parallel relationship to one another (and with respect to elongated member 12*b*) using a plurality of rivets 37 and pins 39. Rivets 37 may pass through a plurality of spacers 41 which space parallel members 35 from one another about elongated member 12*b*. Pivot pin 18 may also be coupled with a nut 19 to retain pin 18 within slot 24 and to couple elongated members 12*a*, 12*b* with one another. An insert 43 is provided intermediate parallel members 35 adjacent to jaw 14 to receive retaining devices 32 and provide the cutting blades 22 attached to elongated member 12*a* in proper lateral and opposing alignment with the cutting blades 22 of elongated member 12*b*.

Figure 4:
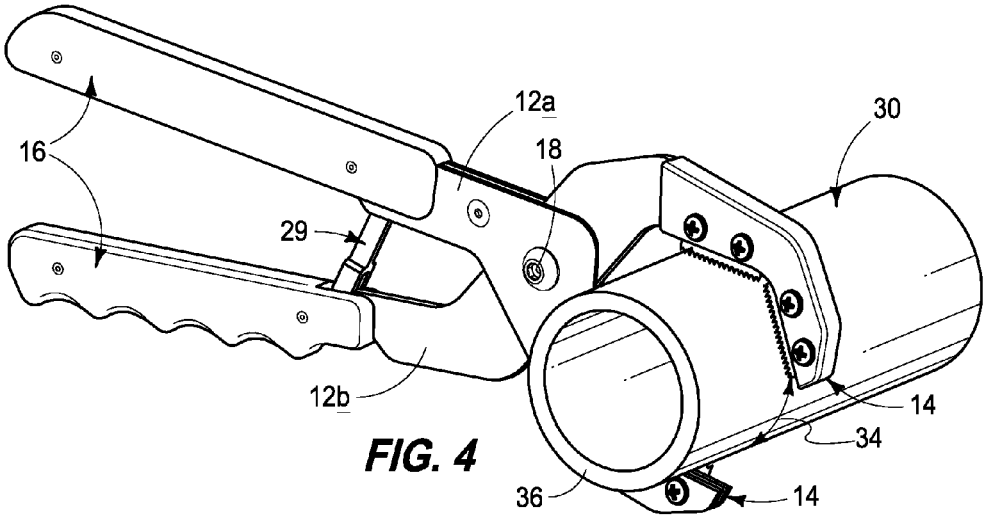
FIG. 4 is a perspective view of a conduit cutting tool according to one embodiment during use.

Referring to FIG. 4, example operations of the conduit cutting tool 10 are described according to one embodiment. Initially, the tool 10 is provided in the open configuration and a conduit 30 to be cut is received within jaws 14. The application of an input force to handles 16 forces handles 16 towards one another and causes the cutting blades 22 to engage wall 32 of conduit 30. The tool 10 may be rotated about the circumference of the conduit 30 to scribe 34 the conduit 30 at an appropriate location for cutting. Thereafter, additional input force may be applied to squeeze the handles 16 together further while the tool 10 is rotated back and forth about the circumference of the conduit 30 which causes the cutting blades 22 to cut into conduit 30 a pre-determined depth corresponding to the thickness of wall 32 of the conduit 30 and which provides the tool 10 in the closed configuration.

The upper surfaces of elongated members 12*a*, 12*b* are spaced from one another at an angle of approximately 15.5 degrees in the open configuration and approximately 7.3 degrees in the closed configuration in one embodiment. In addition, elongated member 12*a* extends 7.94" from pivot pin 18 to the end of grip cover 26 and elongated member 12*b* extends 7.307" from pivot pin 18 to the end of grip cover 26 in one embodiment. Jaw 14 of elongated member 12*a* extends outwardly 3.060" from the pivot pin 18, jaw 14 of elongated member 12*b* extends outwardly 3.55" from the pivot pin 18, elongated member 12*b* is 11.5" long from the end of jaw 14 to the end of handle 26, and segments 14*c* of jaws 14 have a thickness of 0.625" in one embodiment. Jaws 14 are spaced from one another when tool 10 is in the open configuration to receive conduits 30 having a diameter of 2.528 inches or less in one embodiment.

In one embodiment described above, the cutting blades 22 are selected which protrude from the interior surfaces 15 of the jaws 14 by a distance d3 which is the same as the thickness of the wall 32 of the conduit 30 to be cut. During the cutting of the conduit 30, interior surfaces 15 of the jaws 14 eventually contact the outer surface of wall 32 as shown in FIG. 5 and prevent the cutting blades 22 from protruding past the wall 32 into the internal portion of the conduit 30 and avoiding damage to internal contents of the conduit 30, such as wires (not shown). Cutting blades 22 which protrude different distances d3 from interior surfaces 15 of jaws 14 may be installed and used to cut conduits 30 of other gauges, and worn cutting blades 22 may be replaced in example embodiments. In the example of FIG. 5, the cutting blades 22 encircle a majority of the circumference of the conduit 30 being cut.

In some embodiments, the cutting blades 22 are knife-edges capable of bi-directional use to cut through wall 32 of conduit 30 while the cutting tool 10 is rotated back and forth about the circumference of conduit 30. In one more specific embodiment, the cutting blades 22 are knife-edge V-tooth blades with 14 teeth per inch and with individual teeth extending outwardly 0.75" and being approximately 0.020" thick. In addition, the cutting blades 22 may comprise a durable material, such as stainless steel, which is suitable for cutting numerous conduits 30.

Figure 6:
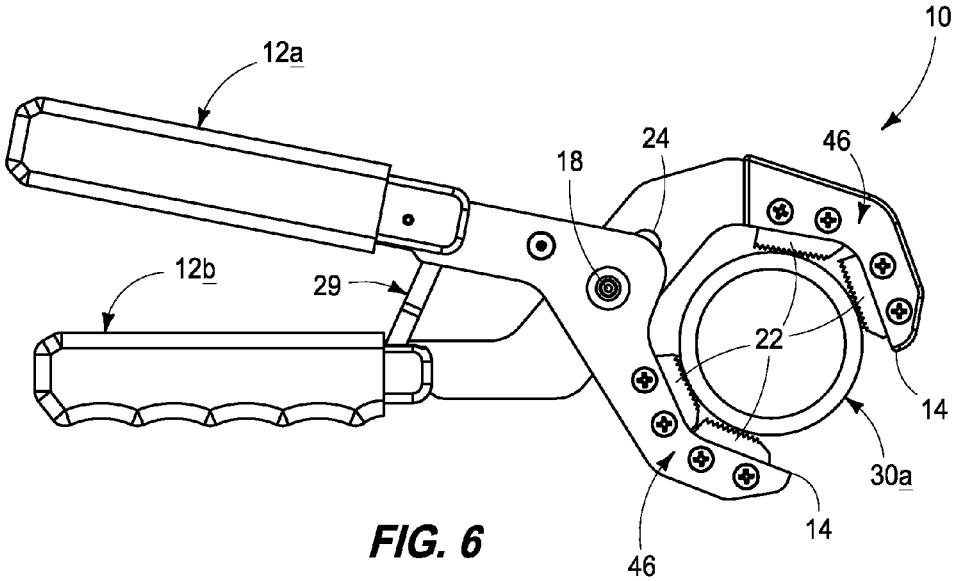
FIGS. 6 and 7 are illustrative representations of a conduit cutting tool according to one embodiment engaging conduits having different diameters.
Figure 7:
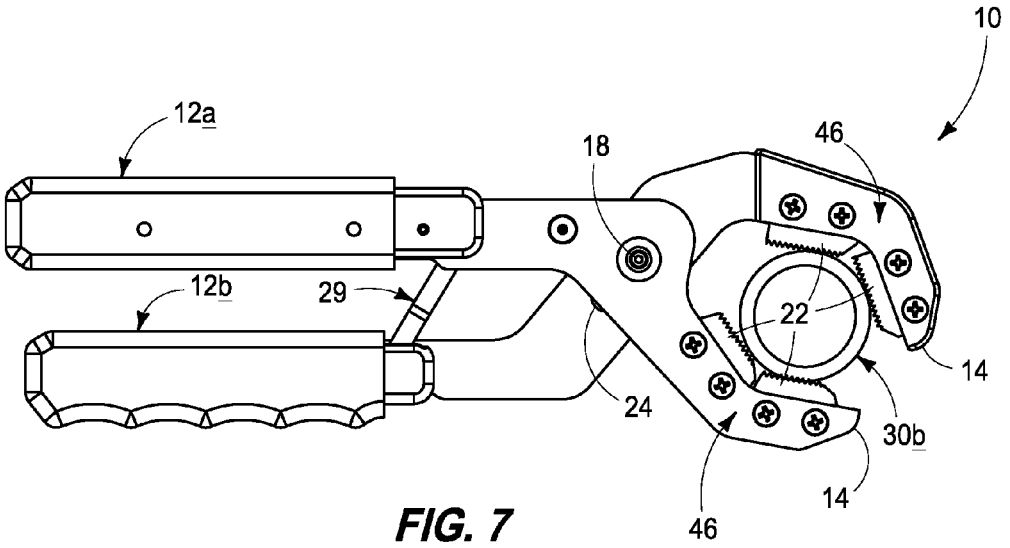

Referring to FIGS. 6-7, conduit cutting tool 10 may be utilized to cut conduits 30*a*, 30*b* of different diameters. For example, conduit 30*a* has a diameter of 2.375" and conduit 30*b* has a diameter of 1.66". The combination of elements including the pivot pin 18, slot 24, linkage 29 and spring 52 (shown in FIG. 8) may be referred to as an adjustment system which operates to control the position of the jaws 14 relative to one another and to accommodate different diameters of conduits to be cut.

The cutting blades 22 of the jaws 14 form a plurality of vertices 46 which receive the conduits 30*a*, 30*b* during rotation of the tool 10 about the conduits 30*a*, 30*b* to cut the conduits 30*a*, 30*b*. The illustrated example arrangement of cutting blades 22 with vertices 43 enables contact of the blades 22 with conduits 30*a*, 30*b* of different diameters. The pivot pin 18 is located at different positions within slot 24 during initial engagement of cutting blades 22 with the conduits 30*a*, 30*b* resulting from the jaws 14 being spaced apart from one another by different linear distances corresponding to the different diameters of the conduits 30*a*, 30*b*.

Figure 8:
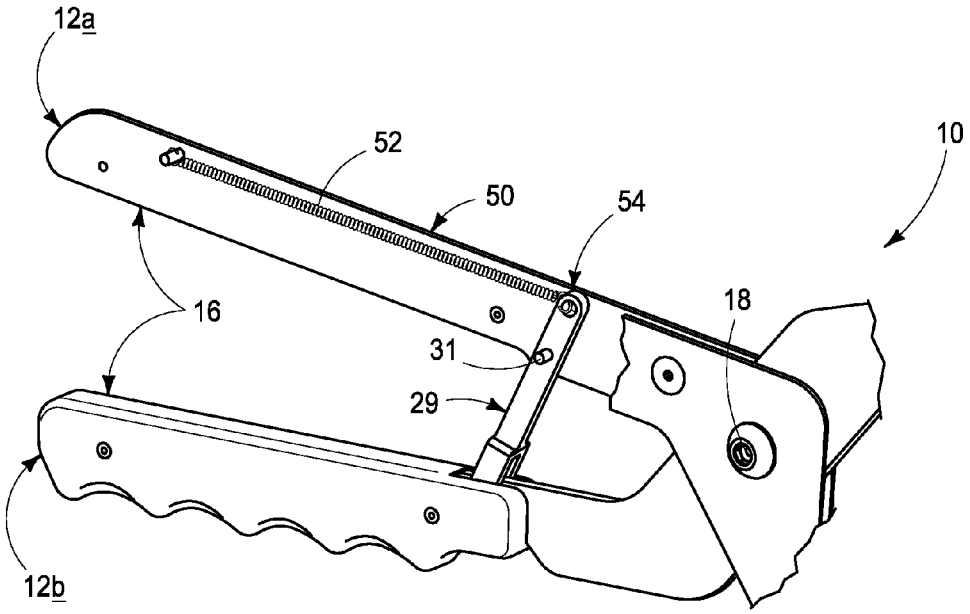
FIG. 8 is a perspective view of a bias system of a conduit cutting tool according to one embodiment.

Referring to FIG. 8, conduit cutting tool 10 includes a bias system 50 which is configured to bias the handles 16 apart from one another to provide the conduit cutting tool 10 in the open configuration where the handles 16 are farthest apart from one another in the absence of an input force applied by the user to move handles 16 towards one another. In one embodiment, bias system 50 includes a compression spring 52 which is coupled with an end 54 of linkage 29 and elongated member 12*a*. The spring 52 provides a bias force which maintains tool 10 in the open configuration where the handles 16 are spaced apart from one another.

The application of an input force by a user to force handles 16 closer together operates to stretch spring 50 and increases the spring tension. The tension of spring 50 returns the conduit cutting tool 10 to the open configuration after removal of the input force to the handles 16 by the user.

The provision of bias system 50 facilitates use of the tool 10 with one hand by an operator as the handles 16 are maintained apart from one another in the open configuration which allows the user to position the tool 10 at an appropriate location about the conduit 30 using a single hand. Thereafter, the force applied to the handles 16 by the hand of the operator may be increased as the tool 10 is rotated back and forth about the conduit 30 to cut the conduit 30.

At least some aspects of the disclosure provide conduit cutting tools and methods of operation which provide reduced risk of electrical shock and damage to wires (or other contents) which are inside of a conduit during cutting of the conduit compared with use of other conventional cutting tools. Some of the example described embodiments provide conduit cutting tools which may cut conduits of different gauges and diameters. In addition, some embodiments of the disclosure provide tools which include a bias system to bias the tools in an open configuration as described above.

CONCLUSION

In some embodiments, a conduit cutting tool comprises a pivot pin defining a pivot axis, a pair of elongated members coupled with one another by the pivot pin, and wherein the elongated members individually comprise a jaw at a first end and a handle at a second end and interior portions of the jaws comprise cutting blades which are configured to cut the conduit, wherein the jaws are spaced apart from one another by a first distance when the conduit cutting tool is in an open configuration to receive a conduit to be cut between the jaws and one of the elongated members is configured to move with respect to an other of the elongated members as a result of an application of an input force to the handles to provide the tool in a closed configuration wherein the jaws are spaced apart from one another by a second distance less than the first distance to cut the conduit, and wherein the movement of the one elongated member rotates the jaw of the one elongated member towards the jaw of the other elongated member and moves the jaw of the one elongated member in a substantially linear direction towards the jaw of the other elongated member.

In some embodiments, a conduit cutting tool comprises a pivot pin defining a pivot axis, a pair of elongated members coupled with one another by the pivot pin, and wherein the elongated members individually comprise a jaw at a first end and a handle at a second end and interior portions of the jaws include cutting blades which are configured to cut the conduit, wherein a first of the elongated members is configured to rotate about the pivot axis as a result of an application of an input force to the handles, wherein a second of the elongated members comprises a slot configured to receive the pivot pin, a linkage coupled with the handles of the elongated members and configured to cause movement of the pivot pin within the slot as a result of the application of the input force to the handles, and wherein the application of the input force to the handles changes the conduit cutting tool from an open configuration wherein a conduit to be cut is received between the jaws to a closed configuration to cut the conduit.

In some embodiments, a conduit cutting tool operational method comprises providing a plurality of jaws of a conduit cutting tool about a conduit to be cut, the interior surfaces of the jaws comprising cutting blades configured to cut the conduit, applying a force to a plurality of handles coupled with the jaws to move the handles towards one another, as a result of the applying, moving one of the jaws in a substantially linear direction towards an other of the jaws and rotating the one jaw towards the other jaw, and during the applying, moving the conduit cutting tool back and forth around a circumference of the conduit to cut the conduit using the cutting blades.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended aspects appropriately interpreted in accordance with the doctrine of equivalents.

Further, aspects herein have been presented for guidance in construction and/or operation of illustrative embodiments of the disclosure. Applicant(s) hereof consider these described illustrative embodiments to also include, disclose and describe further inventive aspects in addition to those explicitly disclosed. For example, the additional inventive aspects may include less, more and/or alternative features than those described in the illustrative embodiments. In more specific examples, Applicants consider the disclosure to include, disclose and describe methods which include less, more and/or alternative steps than those methods explicitly disclosed as well as apparatus which includes less, more and/or alternative structure than the explicitly disclosed structure.

What is claimed is:

1. A conduit cutting tool comprising:

a pivot pin defining a pivot axis;

a pair of elongated members coupled with one another by the pivot pin, and wherein the elongated members individually comprise a jaw at a first end and a handle at a second end and interior portions of the jaws comprise cutting blades which are configured to cut a conduit;

wherein the jaws are spaced apart from one another by a first distance when the conduit cutting tool is in an open configuration to receive the conduit to be cut between the jaws and one of the elongated members is configured to move with respect to an other of the elongated members as a result of an application of an input force to at least one of the handles to provide the tool in a closed configuration wherein the jaws are spaced apart from one another by a second distance less than the first distance to cut the conduit;

wherein the elongated members are configured to allow the jaw of the one elongated member to rotate towards the jaw of the other elongated member and to move in a substantially linear direction towards the jaw of the other elongated member during the movement of the one elongated member with respect to the other elongated member;

wherein the other elongated member comprises a slot and the pivot pin moves within the slot during the movement of the one elongated member with respect to the other elongated member;

a linkage coupled with the handles of the elongated members and which is configured to cause the movement of the pivot pin within the slot during the movement of the one elongated member with respect to the other elongated member;

wherein the linkage is coupled with and configured to rotate about another pivot pin which is coupled with the one elongated member during the movement of the one elongated member with respect to the other elongated member;

a spring configured to bias the handles apart from one another to provide the conduit cutting tool in the open configuration in the absence of the input force; and wherein a first end of the linkage is coupled with the other elongated member and the spring is coupled with a second end of the linkage which is opposite to the first end of the linkage.

2. The tool of claim 1 wherein the slot defines the substantially linear movement of the jaw of the one elongated member in a straight line towards the jaw of the other elongated member.

3. The tool of claim 1 wherein the jaw of the one elongated member rotates about the pivot pin during the movement of the one elongated member with respect to the other elongated member.

4. The tool of claim 1 wherein the another pivot pin is between the first and second ends of the linkage.

5. The tool of claim 1 wherein individual ones of the jaws include at least three substantially linear segments.

6. The tool of claim 1 wherein the cutting blades extend a distance outwardly from surfaces of the jaws which corresponds to a gauge of the conduit.

* * * * *